US008863591B2

(12) United States Patent
Leicht

(10) Patent No.: US 8,863,591 B2
(45) Date of Patent: Oct. 21, 2014

(54) METHOD FOR ACCURATELY MEASURING APPLIED TORQUE IN A HYDRAULIC BREAKOUT MACHINE AND A HYDRAULIC BREAKOUT MACHINE THAT MEASURES APPLIED TORQUE

(76) Inventor: Eugene Leicht, Leduc (CA)

( * ) Notice: Subject to any disclaimer, the term of this patent is extended or adjusted under 35 U.S.C. 154(b) by 488 days.

(21) Appl. No.: 13/020,221

(22) Filed: Feb. 3, 2011

(65) Prior Publication Data

US 2011/0197715 A1 Aug. 18, 2011

(30) Foreign Application Priority Data

Feb. 18, 2010 (CA) ..... 2694060

(51) Int. Cl.
*G01L 3/00* (2006.01)
*E21B 19/16* (2006.01)

(52) U.S. Cl.
CPC ..... *E21B 19/166* (2013.01)
USPC ..... 73/862.08

(58) Field of Classification Search
CPC ..... E21B 19/16; B25B 23/145
USPC ..... 73/862
See application file for complete search history.

(56) References Cited

U.S. PATENT DOCUMENTS

2004/0237726 A1* 12/2004 Schulze Beckinghausen ..... 81/57.34
2006/0179980 A1* 8/2006 Pietras et al. ..... 81/57.16

OTHER PUBLICATIONS

"Cougar BU3-15000 Breakout Unit" (Overview and Specs), Cougar Drilling Solutions, <http://www.cougards.com/?tool=breakout-unit>, available as early as Feb. 2008, 3 pages.

* cited by examiner

*Primary Examiner* — Lisa Caputo
*Assistant Examiner* — Brandi N Hopkins
(74) *Attorney, Agent, or Firm* — Christensen O'Connor Johnson Kindness PLLC

(57) ABSTRACT

A method of accurately measuring applied torque in a hydraulic breakout machine involves using at least one sensor to measure reactive torque, and using the reactive torque measurement as an accurate indication of applied torque.

2 Claims, 3 Drawing Sheets

METHOD FOR ACCURATELY MEASURING APPLIED TORQUE IN A HYDRAULIC BREAKOUT MACHINE AND A HYDRAULIC BREAKOUT MACHINE THAT MEASURES APPLIED TORQUE

FIELD

A hydraulic breakout machine used to apply torque to couple and uncouple threaded tubular components. There is described a method of accurately measuring applied torque in a hydraulic breakout machine and a hydraulic breakout machine that measures applied torque in accordance with the teachings of the method.

BACKGROUND

Operation of a typical breakout machine involves positioning the work piece in the headstock and closing the clamp cylinder onto the work piece, which anchors the work piece to the bed, then positioning the tailstock at the appropriate position and closing the clamping cylinders. The generated force is applied through the fixed moment arm, which applies that generated torque to the work piece. The magnitude of the torque is variable, by adjusting the pressure that is applied to the torque cylinders.

Breakout machines currently use hydraulic pressure supplied to the torque cylinders to determine the magnitude of the torque being applied to the work piece. The hydraulic pressure supplied to the torque cylinders is varied to adjust the torque output. The torque cylinder piston area (break side) and the piston area minus the rod area (make side) are set, as well as the moment arm length or the torque cylinders. At a given pressure, the force generated multiplied by the torque arm length is used to determine the magnitude of the torque applied by one of the torque cylinders and then multiplied by two. Two torque cylinders applying torque in unison is the preferred method, as it reduces the amount of error. There are errors caused by the hydraulic system, mechanical system, as well as the geometry of the machine that limit its accuracy and performance.

Hydraulic system errors are the total sum of all the small losses due to flow through the hydraulic components and force lost to friction operating components. Pressure and flow moves pistons or valve spools and have spring forces to work against. Each hydraulic component has a number of seals or wear rings that cause pressure losses. The clamp cylinders along with the torque cylinders are relatively large cylinders that all have large stiff seals and large wear rings. These components can be designed to minimize these losses, but the combination of these components can cause significant total loss. The system pressure applied to the torque cylinders must be accurate when varied from 0 through 3,000 psi. An error of 100 psi is not significant at the maximum system pressure of 3,000 psi, but such an error is significant to the accuracy of the lower range of torque application. The hydraulic error outlined is one of the errors that limits the accuracy of the torque that can be applied at the low end of its range. Generally, existing machines offer a minimum torque application of 4,000 lb-ft to 5,000 lb-ft is specified for the "make up" range. Current drilling industry practice is to use smaller diameter tools with smaller diameter threaded connections, which call for lower make up torques being applied. This limits the applications of current breakout machines.

Mechanical errors are caused by the bearings, hinges, pivot points, and hoses all causing friction during operation. Good design practice reduces the friction these items cause. A good maintenance/lubrication program will minimize the friction and wear caused, but will not eliminate it. As the machine is operated friction and wear will occur.

The arrangement of the torque cylinders causes an error due to the arc the cylinders travel through a make/break cycle. The moment arm length changing through the torque cylinder travel causes this error, the moment arm length is used to determine the magnitude of the torque being applied. Breakout machines that use the system pressure to determine the torque being applied must have a set moment arm length. Using a moment arm length in one position or an average moment arm length all add an error due to the geometry. Again, good design practice can be used to minimize this error. One method is to limit the arc length the torque cylinders travel. Smaller arc travel results in less moment arm length change, but require more arc travel cycles to complete one full revolution of the work piece.

The errors combine to create a total amount of error affecting the accuracy of the torque being applied. The effects of wear and tear on a machine and its systems results in a breakout machine that requires re-certification on a annual or bi-annual basis to maintain accurate torque application. The re-certification process is at the end users expense and can be very expensive. The result of the re-certification process, is a chart that indicates the actual torque being applied for a given torque setting read on the breakout machine. This can be very confusing to the operator who has go back and forth between the chart and the machine to determine the torque output, increasing the possibility of operator error.

SUMMARY

According to one aspect, there is provided a method of accurately measuring applied torque in a hydraulic breakout machine. The method involves using at least one sensor to measure reactive torque and using the reactive torque measurement as an accurate indication of applied torque.

According to another aspect, there is provided a hydraulic breakout machine that includes a bed with a headstock fixed to the bed. The headstock has clamping cylinders for clamping a work piece to the headstock. A tailstock is movable along the bed. The tailstock has clamping cylinders for clamping a work piece to the tailstock. The tailstock or the headstock has torque cylinders for applying rotational torque to the work piece. At least one sensor is provided for measuring reactive torque.

Measuring reactive torque avoids inaccuracies caused by the hydraulic, mechanical and geometry errors described above. There will hereinafter be described how to measure reactive torque using one or more sensors on the headstock. There is more than one way that this can be done. The preferred way is to provided a reactive torque bracket which is mounted for limited rotational movement within to the headstock. The reactive torque bracket is anchored to the headstock by load sensors, which limit rotational movement and measure reactive torque.

Although beneficial results may be obtained from the apparatus described above, in order to increase the lower operating range of the breakout machines, it is preferred that there be provided two torque cylinders on the tailstock and means for deactivating one of the torque cylinders for operation in lower torque ranges.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
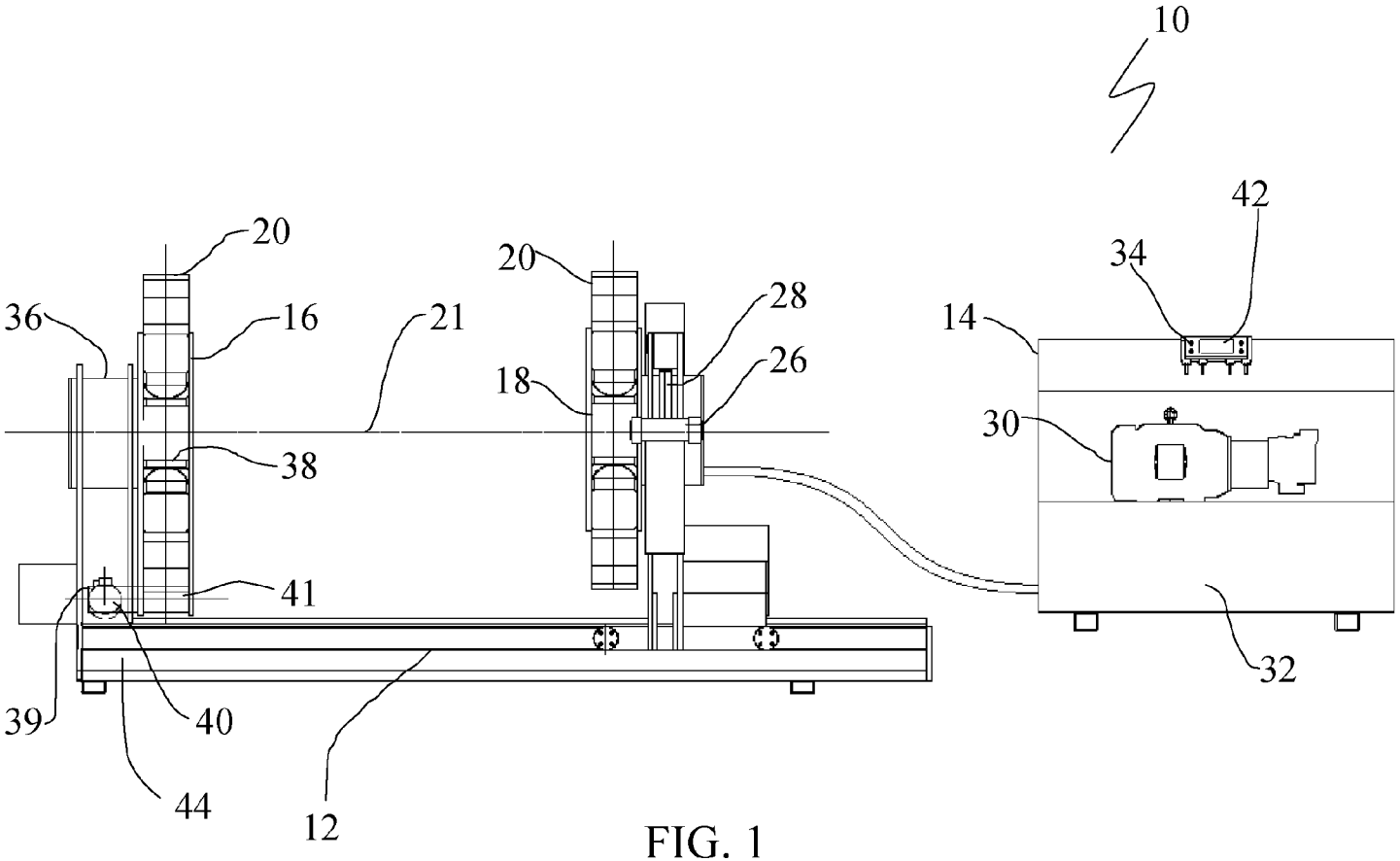
FIG. 1 is a side elevation view of a hydraulic breakout machine.

A hydraulic breakout machine, generally identified by reference numeral 10, will now be described with reference to FIGS. 1 through 4.

Figure 2:
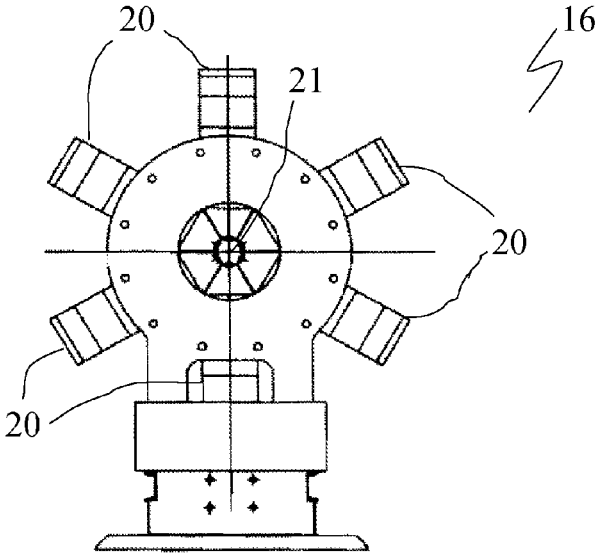
FIG. 2 is a headstock end elevation view of the hydraulic breakout machine of FIG. 1.
Figure 3:
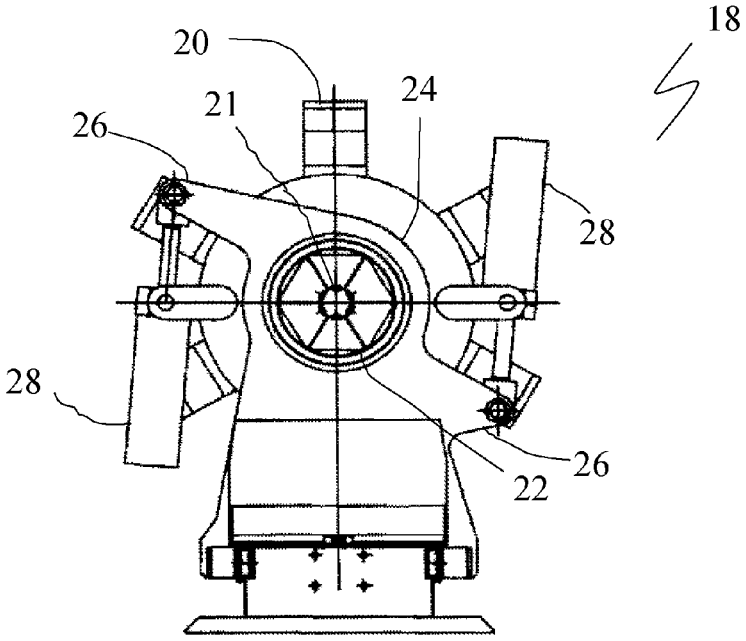
FIG. 3 is a tailstock end elevation view of the hydraulic breakout machine of FIG. 1.

Structure and Relationship of Parts:

Referring to FIG. 1, breakout machine 10 is used for breaking and making threaded connections used on tools and equipment, for example, tools and equipment that may be used for drilling wells. Breakout machine 10 includes a bed 12 and a hydraulic power console 14. Bed 12 extends from zero to approximately sixteen feet or more and has a fixed head stock 16. Bed 12 also includes a movable tailstock 18, which can traverse the length of bed 12. Referring to FIGS. 2 and 3, headstock 16 and tailstock 18 both have hydraulic clamping cylinders 20 mounted in them. Clamping cylinders 20 are mounted in a radial configuration about a work piece centerline 21. In this configuration, clamping cylinders 20 can be stroked open and closed in unison to clamp on work pieces of various diameters. Clamping cylinders 20 on headstock 16 are closed on the work piece holding it in a fixed position. Tailstock 18 is then positioned along the work piece by traversing the length of bed 12. Clamping cylinders 20 of tailstock 18 are then closed at the appropriate position. In this position, tailstock 18 or headstock 16 is capable of applying a torque in a make or break rotation to the work piece. Referring to FIG. 3, tailstock 18 has its radial mounted clamping cylinders 20 held in a large bearing 22 that is free to rotate about the center of the clamping cylinders 20. In turn, a rotating bracket 24 (also referred to as a torque application head) that holds clamping cylinders 20 has two moment arms 26 to which torque cylinders 28 are mounted which can be activated to apply a force through the moment arms 26 resulting in torque being applied to the work piece. In operation, clamping cylinders 20 of headstock 16 and tailstock 18 can be operated individually. Torque cylinders 28 mounted to rotating bracket 24 of tailstock 18 can also be operated independently from clamping cylinders 20. Referring to FIG. 1, hydraulic power console 14 includes a pump 30, a hydraulic reservoir 32, and controls 34 to allow operation and the ability to vary supplied pressure to radial clamping cylinders 20 and torque cylinders 28.

Figure 4:
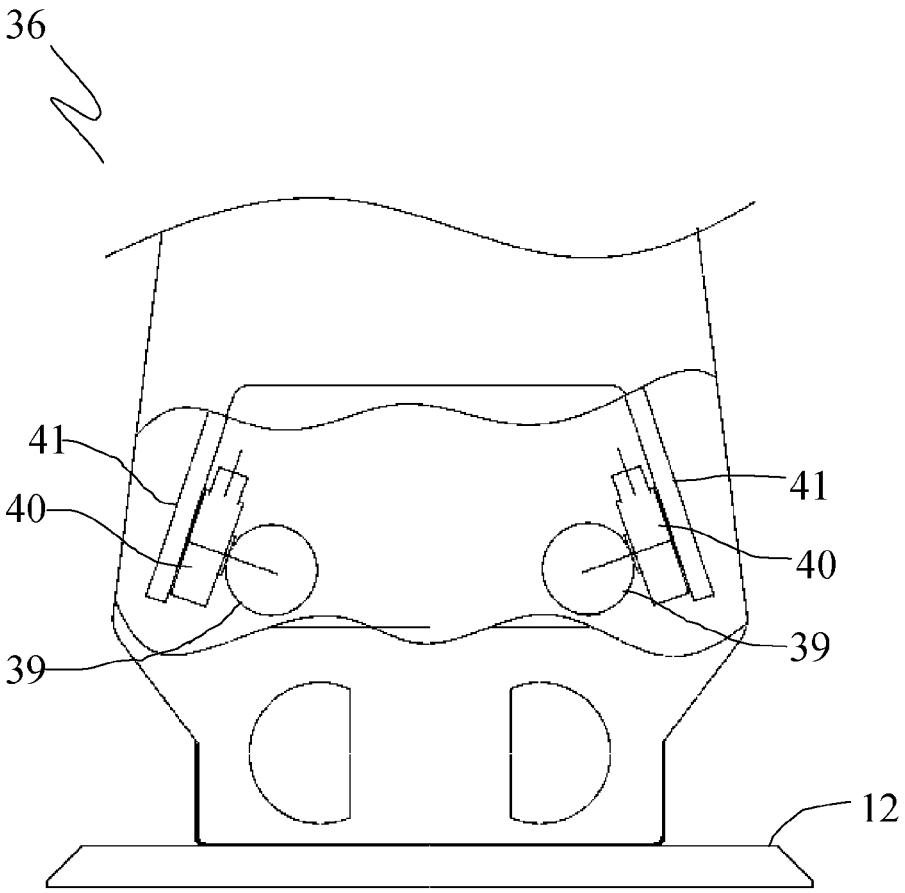
FIG. 4 is partially cutaway end elevation view of a reactive torque bracket.

Referring to FIG. 4, a reactive torque bracket 36 is positioned in headstock 16 supported by bearing 38. Reactive torque bracket 36 is similar to rotating bracket 24 of tailstock 18. Reactive torque bracket 36 has stop members 39 that engage load cells 40, which are attached to a mounting plate 41 on headstock 16. Load cells 40 prevent reactive torque bracket 36 from rotating, and measure the amount of torque experienced by bearing 38. While two load cells 40 are shown, the actual number may vary, and there may only be a single push/pull load cell 40. In the depicted embodiment, it is preferred that reactive torque bracket 36 be free to rotate a minimal amount to prevent erroneous readings from any loads on load cells caused by forces other than reactive torque. Each load cell 40 is mounted between both headstock 16, via mounting plate 41, and reactive torque bracket 36, via stop member 39. Referring to FIG. 1, load cells 40 are coupled to a gauge 42 on hydraulic power console 14 and function as sensors to provide an accurate measurement of reactive torque upon headstock 16. As will hereafter be described, reactive torque gives an accurate indication of the actual torque applied as it is not distorted by the inherent hydraulic, mechanical and geometry errors previously described.

Referring to FIG. 1, breakout machine 10 has a switch 44 that changes from operating on two torque cylinders to one torque cylinder. This can be an automatic pressure sensing switch or a manually selected switch.

The description above and the drawings show rotating bracket 24 with tailstock 18 and reactive torque bracket 36 positioned in headstock 16. In an alternative embodiment, the position of these elements may be reversed, such that torque cylinders 28 and rotating bracket 24 are at headstock 16, and reactive torque bracket 36 is positioned in tailstock 18, with suitable adjustments made to the rest of breakout machine 10 to accommodate for this change, as well as to the operation steps described below.

Operation:

Referring to FIG. 1, in operation, clamping cylinders 20 on headstock 16 are closed on the work piece. Tailstock 18 is then positioned along the work piece by traversing the length of bed 12 and then closing clamping cylinders 20 of tailstock 18 at the appropriate position. Referring to FIG. 3, torque cylinders 28 are then activated to apply a force through the moment arms 26 resulting in torque being applied to the work piece. Instead of using hydraulic pressure delivered to torque cylinders 28 to determine torque output, breakout apparatus 10 determines the torque output utilizing load cells 40. Referring to FIG. 4, as pressure is applied by torque cylinders 28, a reactive torque is applied to reactive torque bracket 36. However, the rotational movement of reactive torque bracket 36 relative to headstock 16 is limited by load cells 40 positioned about the periphery of reactive torque bracket 36 that anchor reactive torque bracket 36 to headstock 16. Referring to FIG. 1, the reactive torque, as measured by load cells 40, is shown as a torque reading by gauge 42 on hydraulic power console 14. The errors outlined previously are still present, but by using reactive torque all of those errors are taken into account, resulting in an accurate torque reading. This results in a direct torque reading by the operator that is more accurate and not sensitive to the position of moment arms 26. The likelihood of operator error is therefore reduced. The wear and tear of operation, which results in changes in the hydraulic and mechanical error, does not affect the resultant reactive torque reading; therefore the requirement for re-calibration of torque output can be greatly reduced, which significantly reduces operating costs. Once reactive torque is utilized for the torque output, the entire layout of the breakout machine may be refined to optimize efficiency. It is no longer necessary to minimize the amount of arc travel to minimize the moment arm error. A simple increase in the arc travel from 30 to 40 degrees rotation changes one full work piece rotation from 12 arc cycles to 9 arc cycles, increasing operator efficiency.

A further feature that significantly increases the ability of breakout machine 10 is its ability to apply low make up torque. Prior art breakout machines are limited in their ability to apply a torque below approximately 5,000 lb-ft. Breakout machine 10 can apply an accurate torque well below that of any other breakout machine. Below a given pressure supplied to the torque cylinders one of the torque cylinders has both sides vented, eliminating that cylinder from providing any force. As previously described, this is made possible through switch 44, which is preferably pressure or manually activated.

In summary, breakout machine 10 advances breakout machine performance in two ways:

1. The use of load sensors measures reactive torque, thereby eliminating hydraulic and mechanical system errors, as well errors due to the geometry.

2. The hydraulic control circuitry has provisions to selectively allow the elimination of one torque cylinder from the load calculation, resulting in a significant reduction in the applied torque.

These differences result in less error, an increase in the lower torque range and a significant reduction of maintenance and operating costs.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A method of accurately measuring applied torque in a hydraulic breakout machine, the hydraulic breakout machine comprising a tailstock end and a headstock end mounted to a horizontal bed, wherein torque is applied to the tailstock end, the method comprising:

anchoring the headstock end to the horizontal bed of the hydraulic breakout machine using a reactive torque bracket, the reactive torque bracket comprising a first sensor for measuring reactive torque applied in a first direction, and a second sensor for measuring reactive torque applied in a second direction, the reactive torque bracket permitting limited rotation in the first direction and the second direction prior to loading the sensor that measures torque in the direction of rotation to unload the sensor that measures torque in the opposite direction;

applying torque to a workpiece at the tailstock end of the hydraulic breakout machine;

measuring reactive torque in the direction of rotation using the loaded sensor; and accepting the reactive torque reading as measured by the loaded sensor as being an accurate indication of applied torque.

2. A hydraulic breakout machine, comprising:

a horizontal bed;

a headstock rotationally fixed to the horizontal bed, the headstock having clamping cylinders for clamping a work piece to the headstock;

a tailstock movable along the horizontal bed, the tailstock having clamping cylinders for clamping a work piece to the tailstock, torque cylinders mounted to the tailstock for applying torque to the work piece; and a reactive torque bracket that anchors the headstock end to the horizontal bed, the reactive torque bracket comprising a first sensor for measuring reactive torque applied in a first direction, and a second sensor for measuring reactive torque applied in a second direction, the reactive torque bracket permitting limited rotation in the first direction and the second direction prior to loading the sensor that measures torque in the direction of rotation to unload the sensor that measures torque in the opposite direction.

* * * * *